US007789025B2

(12) United States Patent
Michaud, II et al.

(10) Patent No.: US 7,789,025 B2
(45) Date of Patent: Sep. 7, 2010

(54) HEIGHT ADJUSTABLE VERTICALLY ORIENTED SCREEN OR THE LIKE

(75) Inventors: Maurice G. Michaud, II, Green Bay, WI (US); Michael J. Mastalir, Green Bay, WI (US); Gregory R. Rentfrow, Tucson, AZ (US); Lon D. Seidl, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 85 days.

(21) Appl. No.: 11/937,110

(22) Filed: Nov. 8, 2007

(65) Prior Publication Data

US 2008/0121149 A1 May 29, 2008

Related U.S. Application Data

(60) Provisional application No. 60/865,107, filed on Nov. 9, 2006.

(51) Int. Cl.
*A47B 57/00* (2006.01)

(52) U.S. Cl. ..... 108/60; 108/147

(58) Field of Classification Search ..... 108/60, 108/147, 106, 50.11, 136; 312/196, 195, 312/140.1
See application file for complete search history.

(56) References Cited

U.S. PATENT DOCUMENTS

| | | | | | |
|---|---|---|---|---|---|
| 1,992,903 | A | * | 2/1935 | Potashnik | 108/60 |
| 2,688,525 | A | * | 9/1954 | Lindstrom | 108/60 |
| 2,944,861 | A | * | 7/1960 | Lessin | 108/60 |
| 3,083,417 | A | * | 4/1963 | Cook | 108/60 |
| 3,117,534 | A | * | 1/1964 | Martland | 108/60 |
| 3,117,535 | A | * | 1/1964 | Hendrickson | 108/60 |
| 3,188,986 | A | * | 6/1965 | La Vigne | 108/136 |
| 3,380,405 | A | * | 4/1968 | Barecki et al. | 108/136 |
| 3,481,286 | A | * | 12/1969 | Pruim et al. | 108/147 |
| 3,905,311 | A | * | 9/1975 | Carpentier | 108/136 |
| 5,408,940 | A | * | 4/1995 | Winchell | 108/147 |
| 5,706,739 | A | * | 1/1998 | Shaheen et al. | 108/147 |

(Continued)

FOREIGN PATENT DOCUMENTS

| | | |
|---|---|---|
| GB | 2319470 | 5/1998 |

(Continued)

OTHER PUBLICATIONS

UK Search Report dated Jan. 14, 2008, Appln. No. GB0722100.5.

*Primary Examiner*—José V Chen
(74) *Attorney, Agent, or Firm*—Andrus, Sceales, Starke & Sawall, LLP

(57) ABSTRACT

A desk or table assembly includes a support member such as a worksurface, and an upright member, which may be in the form of a privacy screen, adjacent an edge of the worksurface. The upright member is interconnected with the support member using a mounting arrangement including a spring to apply a constant upward biasing force on the upright member. The spring resists downward forces applied to the upright member, and assist upward forces applied to the upright member. The spring counterbalances the weight of the upright member so that the upright member is retained at a desired position when moved to the desired position thereto by either a downward or upward external force applied to the upright member.

14 Claims, 10 Drawing Sheets

U.S. PATENT DOCUMENTS 5,743,193 A * 4/1998 Kakuta et al. ..... 108/147
6,062,147 A * 5/2000 Footitt et al. ..... 108/60
6,062,148 A * 5/2000 Hodge et al. ..... 108/147
6,345,547 B1 * 2/2002 Stoelinga et al. ..... 108/147
6,435,111 B1 * 8/2002 Stumpf ..... 108/147
6,474,246 B2 * 11/2002 Hsu ..... 108/147
6,584,917 B2 * 7/2003 Long ..... 108/147

FOREIGN PATENT DOCUMENTS

JP 2000004947 1/2000
JP 2000004950 1/2000

* cited by examiner

HEIGHT ADJUSTABLE VERTICALLY ORIENTED SCREEN OR THE LIKE

CROSS REFERENCE TO RELATED APPLICATIONS

The present application claims the benefit of U.S. Ser. No. 60/865,107 filed Nov. 9, 2006, the disclosure of which is incorporated herein by reference.

BACKGROUND OF THE INVENTION

The present invention is generally directed to office furniture and, more particularly, to a support structure, such as a desk or table, having a vertical member, such as a privacy screen, the height of which can be adjusted in a tool-less manner relative to the support structure.

Office cubicles have long been used to maximize the number of workstations within a given office space. Cubicles provide a relatively private space that can be used by temporary and permanent office personnel as a primary workstation. The walls of a cubicle are typically secured to the floor in a semi-permanent manner. Notwithstanding the proliferation of cubicles as an efficient way of maximize office space, companies are increasingly shunning cubicles in favor of more open space designs.

In these open space designs or layouts, desks are simply arranged around an office space. Space between desks, rather than walls, define each workstation. Studies have suggested that such open space layouts improve employee performance and morale as well as promote teamwork. The very concept that provides such advantages, e.g., wall-less workstations, can also be problematic in some instances. That is, in some circumstances, an employee may desire the privacy that a walled workstation, i.e., a cubicle, can provide. To accommodate such instances, desks and tables have been designed that include privacy screens that can be used, when desired, to provide a wall-like structure. Some such desks are designed such that the screen may be mounted at various heights to allow a user some leeway in setting the height of the screen. More particularly, fasteners, such as bolts, screws, or similar devices, are used to mount the screen to the desk. To reposition the screen, the user must unfasten the fasteners, set the screen to a new desired height, and then refasten the fasteners. Given the weight and size of the privacy screens, it can take two or more people to reposition the screen.

BRIEF DESCRIPTION OF THE INVENTION

The present inventors have developed a vertical member mounting arrangement in which a constant upward biasing force is applied by a spring to a vertical member, such as a privacy screen, supported by a support structure, such as a desk. The spring is designed to resist downward force on the vertical member yet assist upward force on the vertical member. The spring is further designed to counterbalance the weight of the vertical member so that the vertical member is retained at a desired position when it is moved to the desired position by either a downward or upward external force. The mounting arrangement has a guide arrangement that guides vertical movement of the vertical member relative to the support structure. In this regard, the vertical member remains connected to the support structure during any height adjustments.

Therefore, it is an object of the present invention to have a mounting arrangement in which the height of a vertical member can be adjusted without requiring the vertical member to be disconnected from its support structure.

It is a further object of the invention to provide a mounting arrangement in which a vertical member is supported at a desired height relative to the support structure without requiring locks or other retention components.

It is yet a further object of the invention to provide a desk having a vertically oriented privacy screen, in which the vertical position of the screen can be adjusted in a tool-less manner.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings.

DETAILED DESCRIPTION

Figure 1:
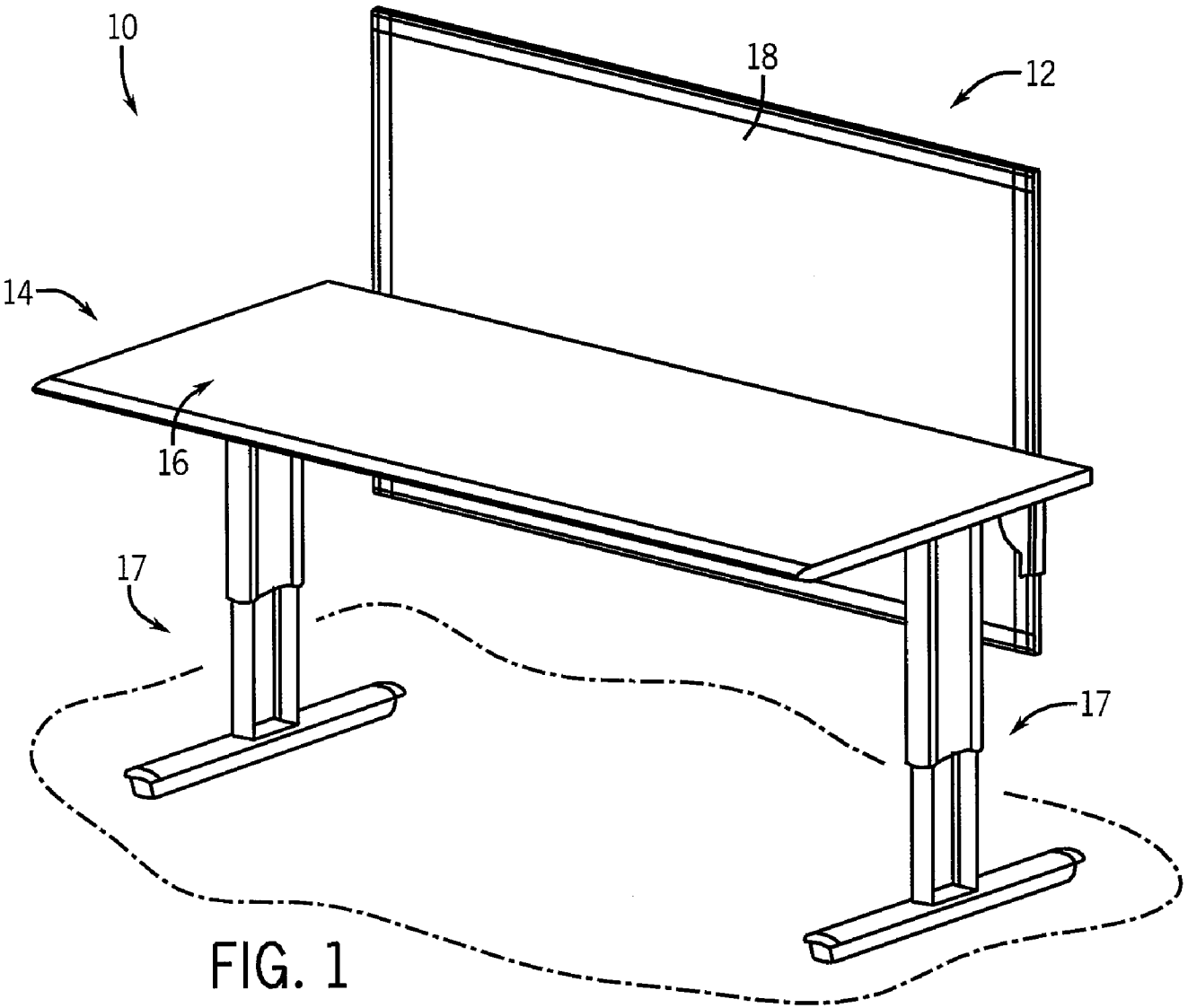
FIG. 1 is an isometric view of a desk having a vertically oriented, height adjustable privacy screen in accordance with the present invention.

Referring to FIG. 1, a desk assembly 10 includes an adjustable height screen 12 that is adapted for mounting to a support structure, which may be in the form of a desk or table 14 that includes a worksurface 16 supported by legs 17, as is known in the art. It is understood that screen 12 may be mounted to any other satisfactory supporting structure other than table 14 that provides a surface to which the mounting mechanism for screen 12 can be secured.

Figure 2:
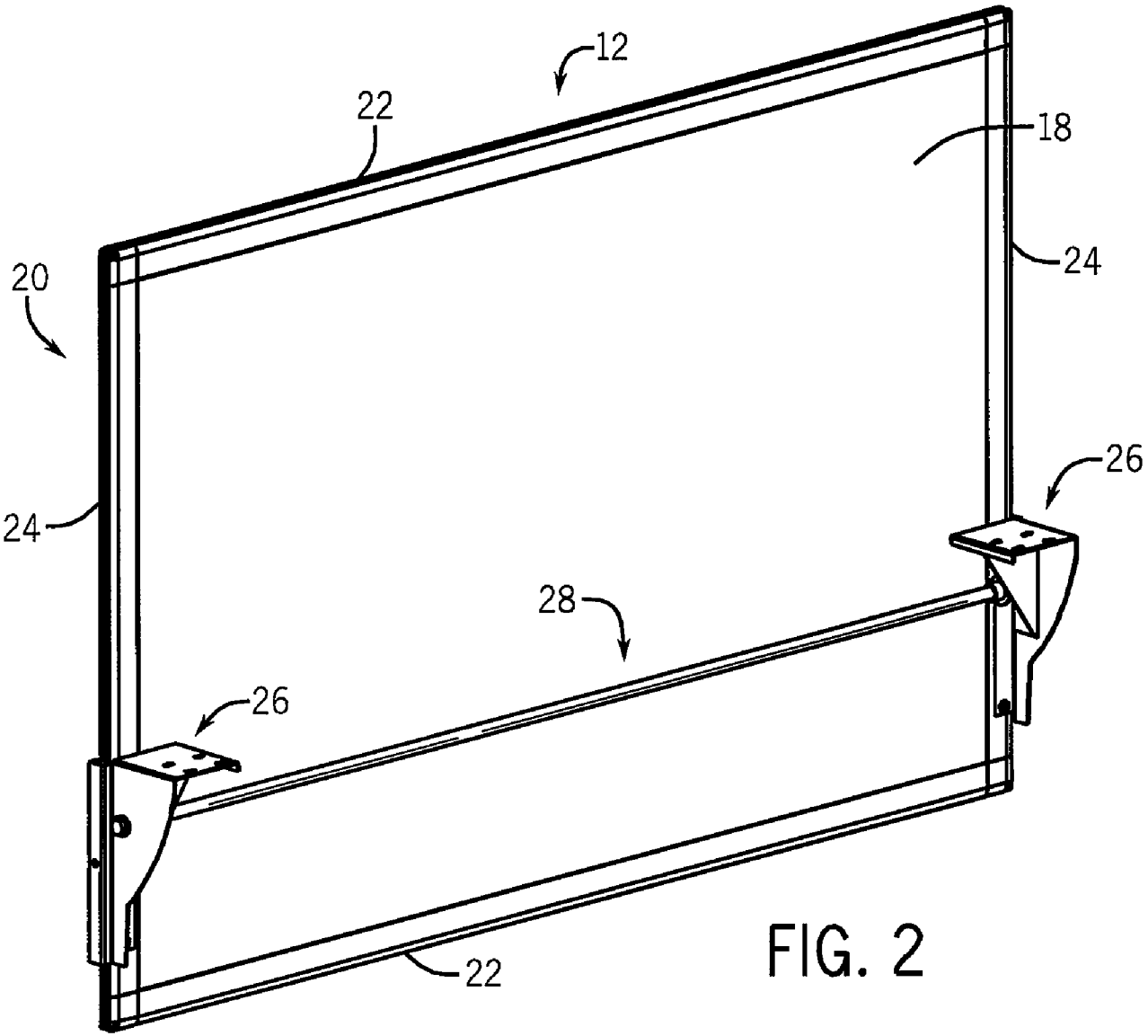
FIG. 2 is an isometric view of the privacy screen shown in FIG. 1.
Figure 3:
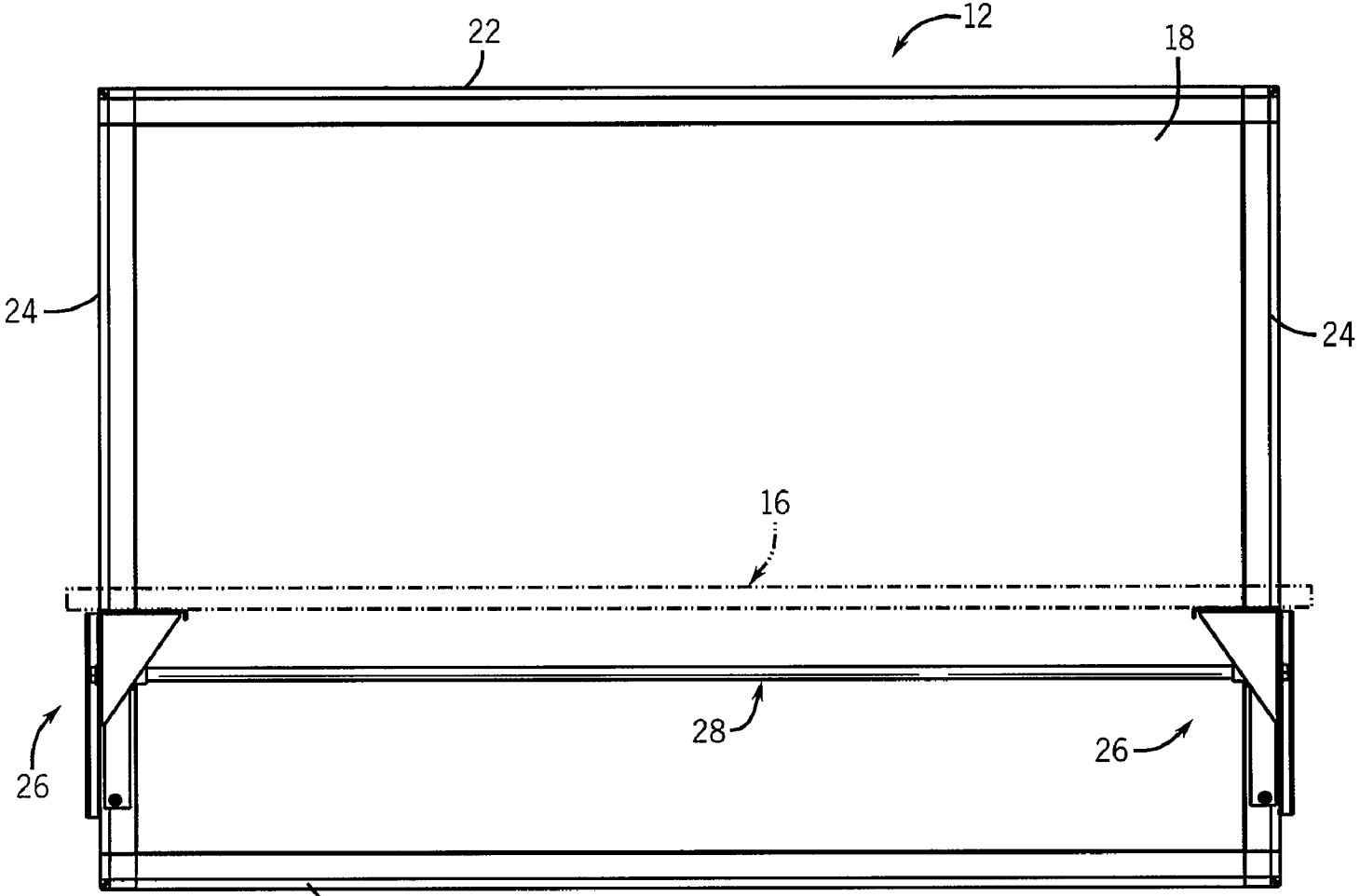
FIG. 3 is a front elevation view of the privacy screen shown in FIG. 2.

With further reference to FIGS. 2-3, screen 12 defines a pair of oppositely facing generally flat surfaces, one of which is shown at 18, and may include a frame 20 or other satisfactory structural support. In one embodiment, the generally flat surfaces are comprised of translucent or opaque materials for privacy purposes, although transparent material may also be used. In the illustrated embodiment, the frame of screen 12 includes a pair of horizontal frame members 22 and a pair of vertical frame members 24. Screen 12 is mounted for vertical movement relative to desk 14 using the height adjustment mechanism of the present invention, as will be described. A pair of support bracket assemblies 26 are secured to the underside of worksurface 16, and each is located adjacent one of vertical frame members 24. The support bracket assemblies 26 are interconnected by a horizontal connecting rod 28.

Figure 5:
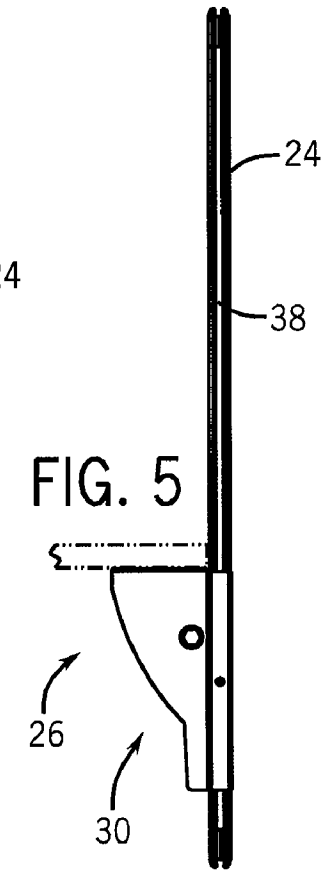
FIG. 5 is a side elevation view of the privacy screen shown in FIG. 2.
Figure 6:
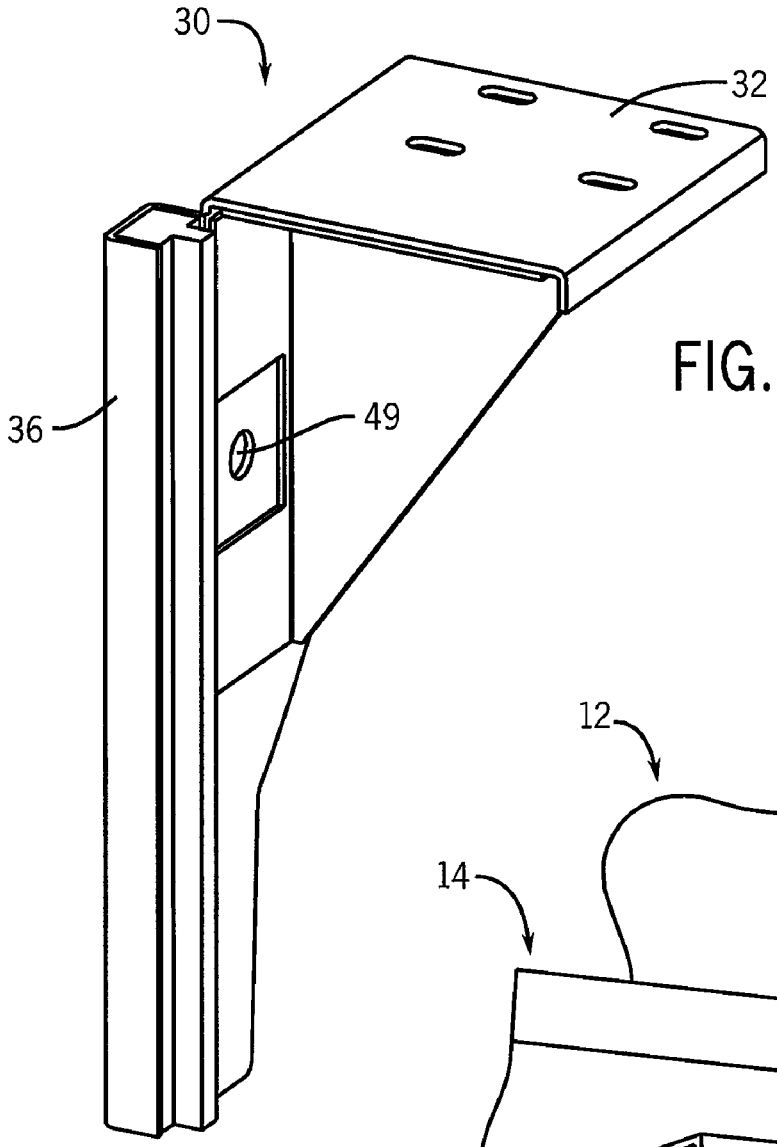
FIG. 6 is an isometric view of the mounting bracket of the bracket assembly shown in FIG. 4.
Figure 4:
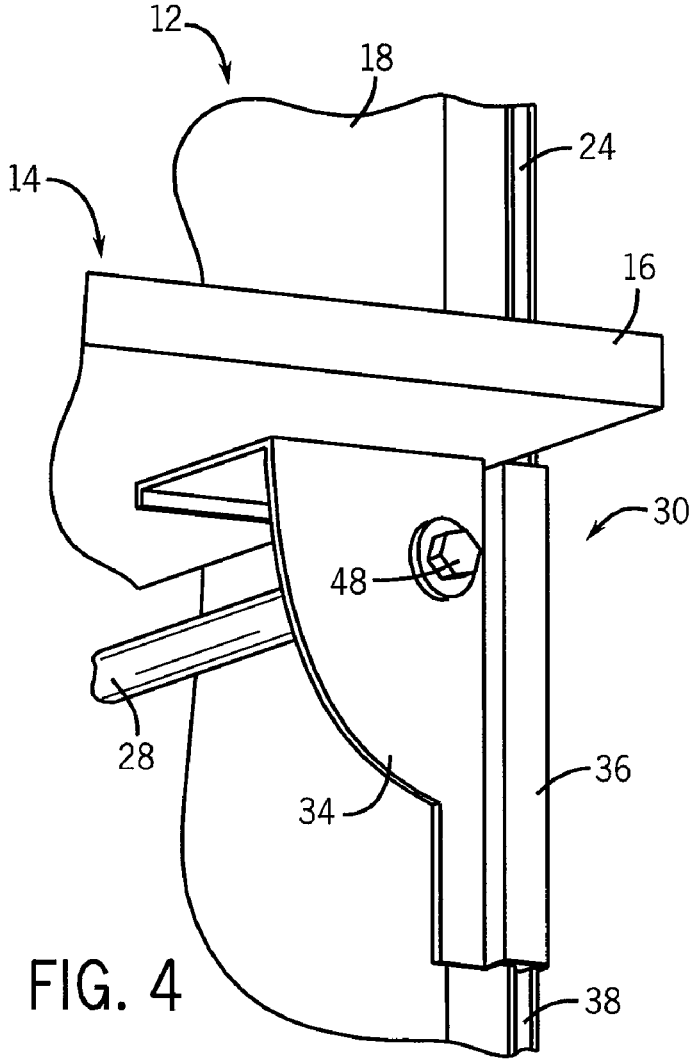
FIG. 4 is an enlarged view of an interconnection of the privacy screen and the desk shown in FIG. 1 using a bracket assembly that allows the height of the privacy screen relative to the desk to be adjusted in a tool-less manner.

As shown in FIGS. 4-6, each mounting bracket assembly 26 includes a mounting bracket 30 having an upper horizontal section 32 that is secured to the underside of worksurface 16, such as by means of screws or the like, and a depending vertical section 34 that extends downwardly from horizontal section 32. Each vertical section 34 defines a guide 36 having an inner member 36*a*, which is engaged within a slot or groove 38 formed in the outwardly facing edge of the adjacent vertical frame member 24, as shown in FIGS. 4 and 6. In this manner, engagement of the guide 36 of support bracket with vertical section 24 guides vertical movement of screen 12 relative to worksurface 16.

Figure 7:
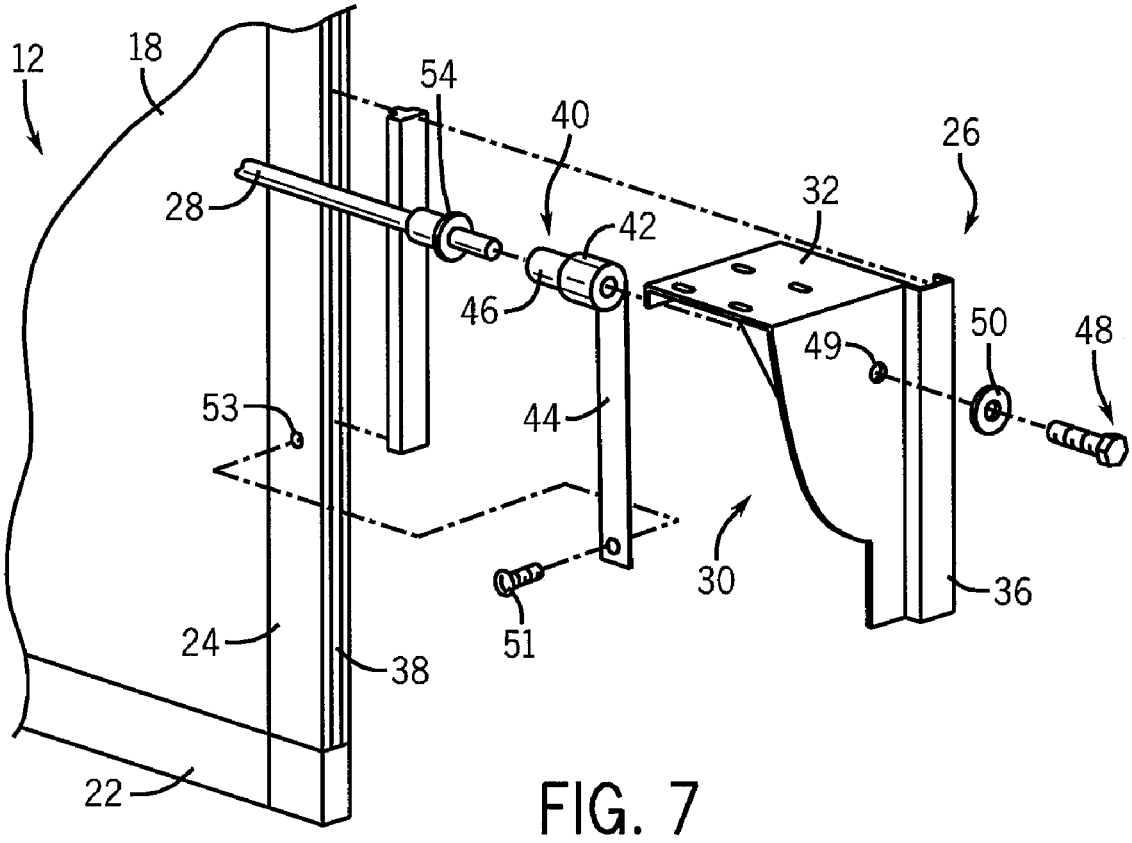
FIG. 7 is an exploded view of the bracket assembly shown in FIG. 4.

Each bracket assembly 26 includes a constant force spring 40 interposed between screen 12 and support bracket 30, which is operable to counterbalance the weight of screen 12. As further shown in FIG. 7, the spring 40 is associated with a cylinder 42 and a spring ribbon or band 44. A bushing 46 is located in cylinder 42, and defines a threaded passage that receives the threaded shank of a bolt 48. As the bolt 48 is threaded to the cylinder via opening 49 of the bracket 30, the bolt 48 will engage the rod and tighten the bracket 30 against the screen 12. In a preferred embodiment, the bolt 48 is inserted through a washer 50 before inserted into opening 49.

The end area of spring band 44 is secured to vertical frame member 24 of screen 12, such as by means of a screw 51 or the like that extends through an opening 52 in the end of spring band 44 and into an aligned threaded opening 53 in vertical frame member 24. Spring 40 is selected to provide an upward biasing force on screen 12 that counterbalances the weight of screen 12, so as to maintain the vertical position of screen 12 relative to worksurface 16.

Figure 8:
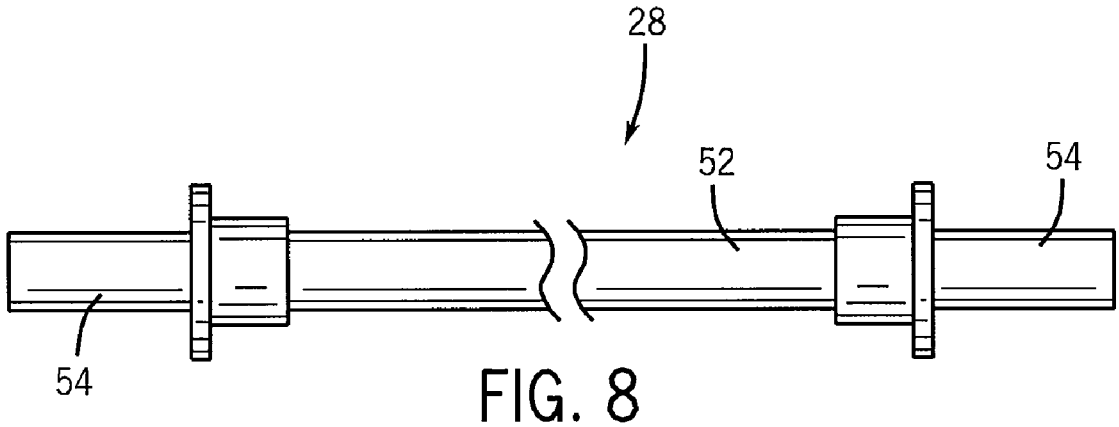
FIG. 8 is a front elevation view of a rod assembly of the privacy screen shown in FIG. 2.

As shown in FIG. 8, the connecting rod 28 has a rod body 52 with an end cap 55 disposed at each end of the rod body 54. Each end cap 55 is sized to fit within the bushing 46 of a respective mounting bracket assembly 26. Each end cap 55 defines a threaded passage for threadingly engaging a respective bolt 48 to secure the brackets 30 to the screen 12. This construction allows the adjustable screen 12 to be fully assembled together with bracket assemblies 26 and then attached to the desk 14 as a single unit.

In operation, a user can adjust the height of screen 12 by application of a manual upward or downward vertical force on screen 12. When doing so, the user applies a downward force on screen 12 that overcomes the biasing force of spring 40 when lowering screen 12 and applies an upward force on screen 12 which is assisted by the biasing force of spring 40 when raising screen 12. When the user ceases to apply the raising or lowering force on screen 12, spring 40 functions to maintain screen 12 in the desired position by counteracting the weight of screen 12. In addition, the point at which the upward biasing force is applied to screen 12 is slightly offset from the location at which the inner edge of inner member 36*a* of support bracket vertical section 34 is engaged within groove 38 of vertical frame member 24. This construction provides a slight tendency to twist screen 12 relative to vertical frame member 24 to cause frictional engagement of the inner edge of inner member 36*a* with the inner surfaces of groove 38 such that, when the user relieves the vertical upward or downward force on screen 12, the frictional engagement of the inner edge of inner member 36*a* with the surfaces of groove 38 also assists in maintaining screen 12 in the desired position.

Figure 9:
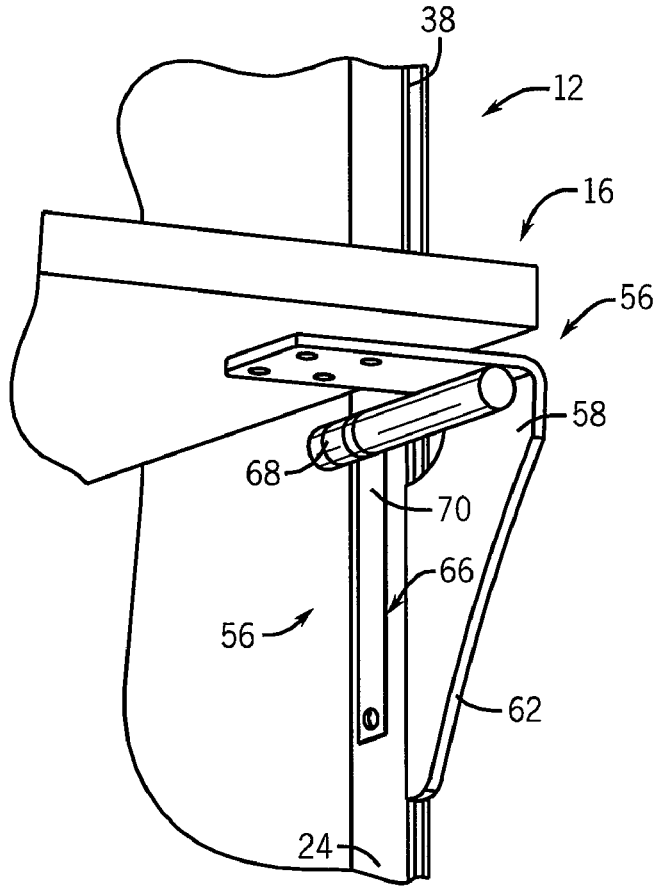
FIG. 9 is an isometric view of a rod-less mounting bracket according to an alternate embodiment of the present invention.
Figure 10:
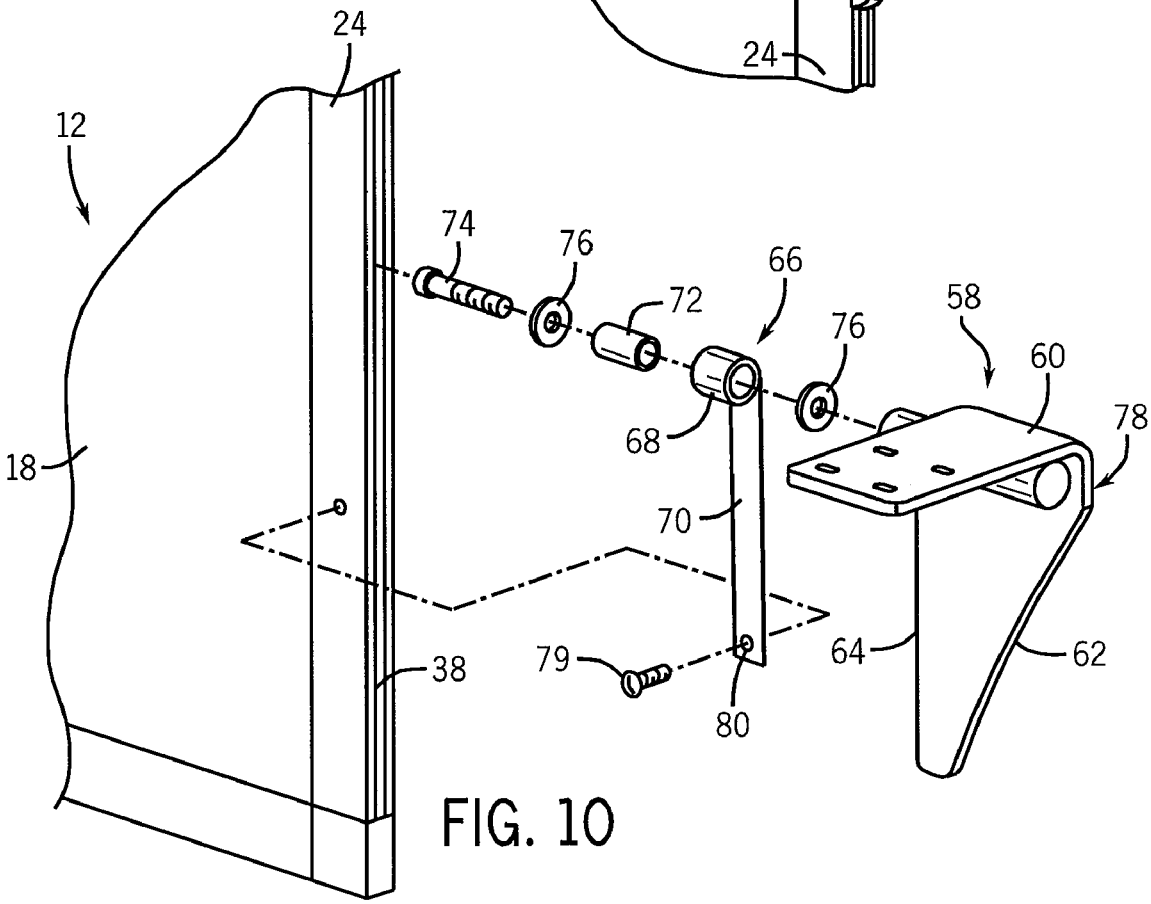
FIG. 10 is an exploded view of the rod-less mounting bracket shown in FIG. 8.

Referring now to FIGS. 9-10, a mounting bracket assembly 56 according to an alternate embodiment of the present invention is shown. The mounting bracket assembly 56 includes a mounting bracket 58 having an upper horizontal section 60 that is secured to the underside of worksurface 16, such as by means of screws or the like, and a depending vertical section 62 that extends downwardly from horizontal section 60. Each vertical section 62 defines an inner edge 64, which is engaged within a slot or groove 38 formed in the outwardly facing edge of the adjacent vertical frame member 24. In this manner, engagement of the inner edges 38 of support bracket vertical sections 62 guides vertical movement of screen 12 relative to worksurface 16.

A respective constant force spring 66 is interposed between screen 12 and each support bracket 58, and is operable to counterbalance the weight of screen 12. Each spring 66 has a cylinder 68 and a spring ribbon or band 70. A bushing 72 is located in cylinder 68, and includes a passage through which the shank of a mounting screw 74 extends. The shank of screw 74 extends through a pair of washers 76 located one on either side of bushing 72 and spring cylinder 68.

A barrel 78 is secured to support bracket 58, adjacent the junction of upper horizontal section 60 and depending vertical section 62. Barrel 78 defines an internal threaded passage, and the shank of screw 74 includes threads that are adapted for engagement with the internal threads of barrel 78. With this arrangement, the shank of screw 74 extends through washers 76 and through the passage of bushing 72, and is secured to barrel 78. The area of the shank of screw 74 within the passage of bushing 72 is not threaded, such that bushing 72 is rotatable on the shank of screw 74. In this manner, bushing 72 and cylinder 68 of constant force spring 66 are rotatable about an axis of rotation defined by the shank of screw 74. Alternatively, bushing 72 may be fixed against rotation by engagement with screw 74, and the cylinder 68 of constant force spring 66 may be rotatable on bushing 72.

The end area of spring band 70 is secured to vertical frame member 24 of screen 12, such as by means of a screw 79 or the like that extends through an opening 80 in the end of spring band 70 and into an aligned threaded opening in vertical frame member 24. Spring 66 is selected to provide an upward biasing force on screen 12 that counterbalances the weight of screen 12, so as to maintain the vertical position of screen 12 relative to worksurface 16.

Figure 11:
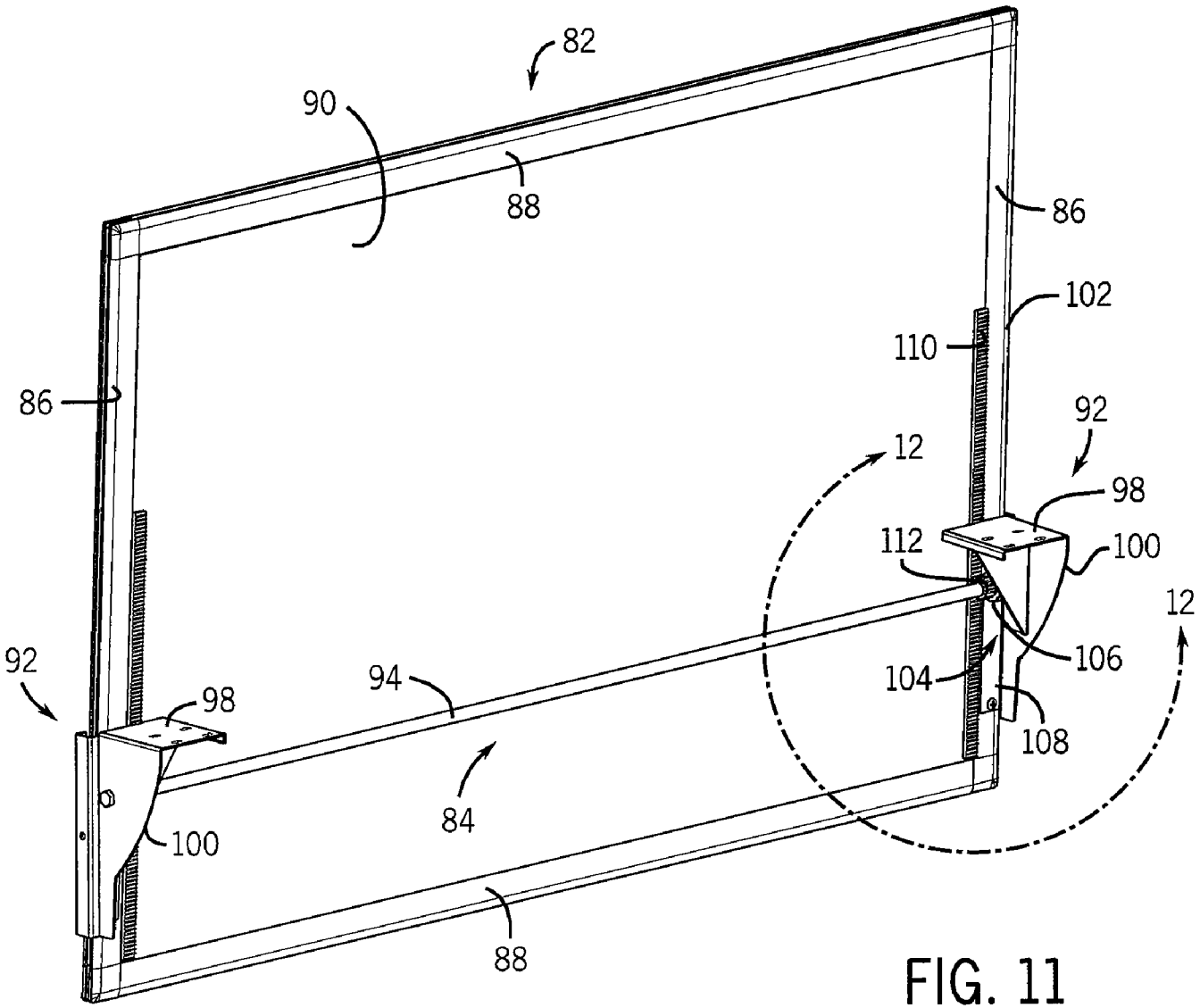
FIG. 11 is an isometric view of a privacy screen and mounting bracket assembly according to another embodiment of the present invention.
Figure 12:
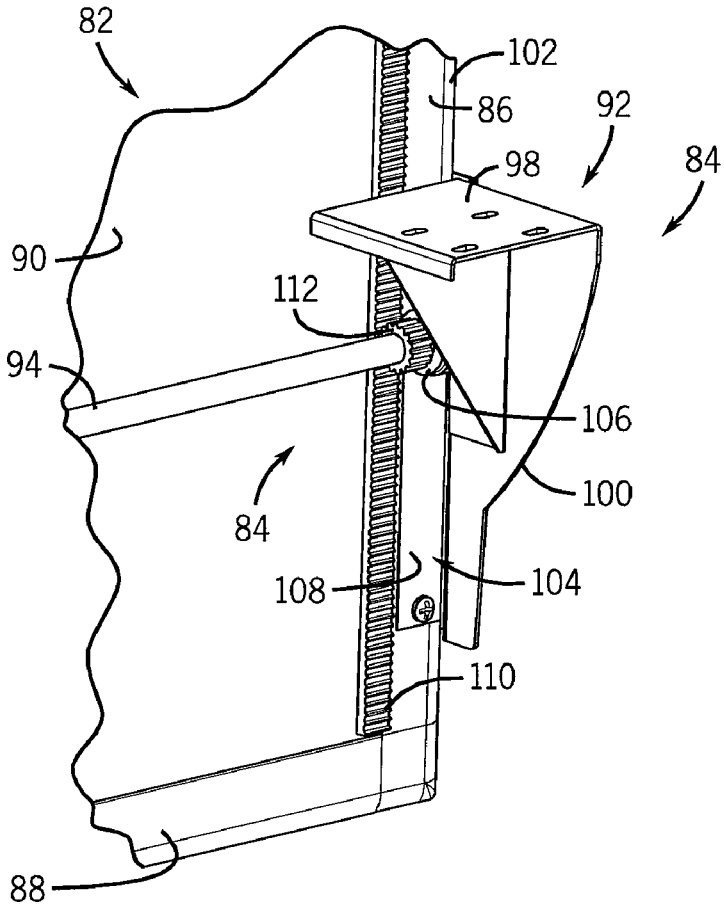
FIG. 12 is an enlarged view of the mounting bracket assembly shown in FIG. 11.

A privacy screen 82 and mounting assembly 84 according to another embodiment of the present invention is shown in FIGS. 11 and 12. Similar to the privacy screen shown in FIGS. 1-9, privacy screen 82 has a pair of upright members 86 connected to one another by a pair of lateral members 88. The upright and horizontal members 84, 86 collectively encase and support a privacy pane 90.

The mounting assembly 84 includes a pair of mounting bracket assemblies 92, each of which is mounted to an upright member 86, and is interconnected to one another by a connecting rod 94. Each mounting bracket assembly 92 has a mounting bracket 96 defined by a upper horizontal section 98 that is secured to the underside of a worksurface, such as by means of screws or the like, and a depending vertical section 100 that extends downwardly from horizontal section 98. Each vertical section 100 defines an inner edge (not shown), which is engaged within a slot or groove 102 formed in the outwardly facing edge of the adjacent vertical frame member 86. In this manner, engagement of the inner edges of support bracket vertical sections guides vertical movement of screen 82 relative to the worksurface.

A respective constant force spring 104 is interposed between screen 82 and each mounting bracket 92, and is operable to counterbalance the weight of screen 82. Each spring 104 has a cylinder 106 and a spring ribbon or band 108. A bushing (not shown) is located in cylinder 106, and includes a passage through which the shank of a mounting screw (not shown) extends to couple the mounting bracket 92 to the connecting rod 94.

A rack and pinion gear arrangement is used to translate the screen 82 along the grooves 102 formed in the upright members 86. More particularly, a pair of upright racks 110 are formed on the privacy pane 90 generally adjacent each upright member 86. Each end of the connecting rod 94 is retained within a pinion 112, each of which is associated with a respective rack 110. In this regard, to adjust the height of the privacy screen 82, a user may pull/push up on connecting rod 94 which cause the pinions 112 to rotate and travel along the teeth formed in racks 110. As the pinions rotate and the privacy screen is moved, the constant biasing spring 104 maintains its bias such that the weight of the privacy screen 82 is supported at any relative position of the privacy screen 82 relative to the worksurface.

The present invention has been described with respect to a desk or table, and an upright member such as a privacy screen mounted to the desk in a manner that allows the height of the privacy screen to be adjusted in a tool-less manner. It is understood, however, that the present invention is applicable with other structural supports to which a vertically oriented member may be mounted. For example, the present invention may be used to adjust the height of a chalkboard or marker board relative to a table, podium, or similar support structure. It is also understood that, while the upright member has been shown and described as being in a vertical orientation, the upright member may be in any other desired angular orientation relative to the support member.

Figure 13:
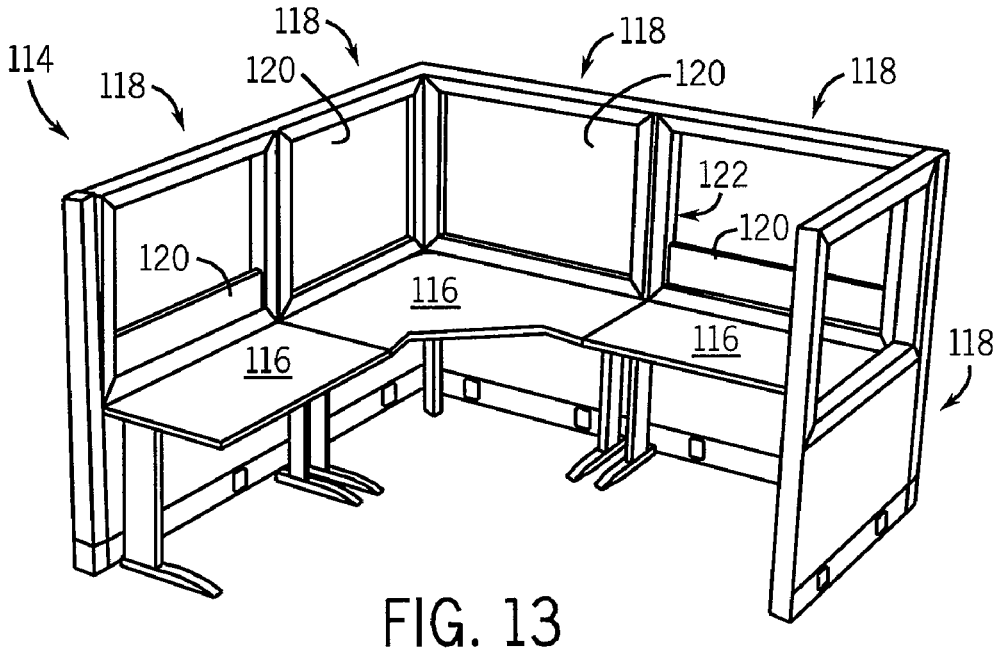
FIG. 13 is an isometric view of a workstation having a plurality of encased privacy screens according to another embodiment of the present invention.
Figure 14:
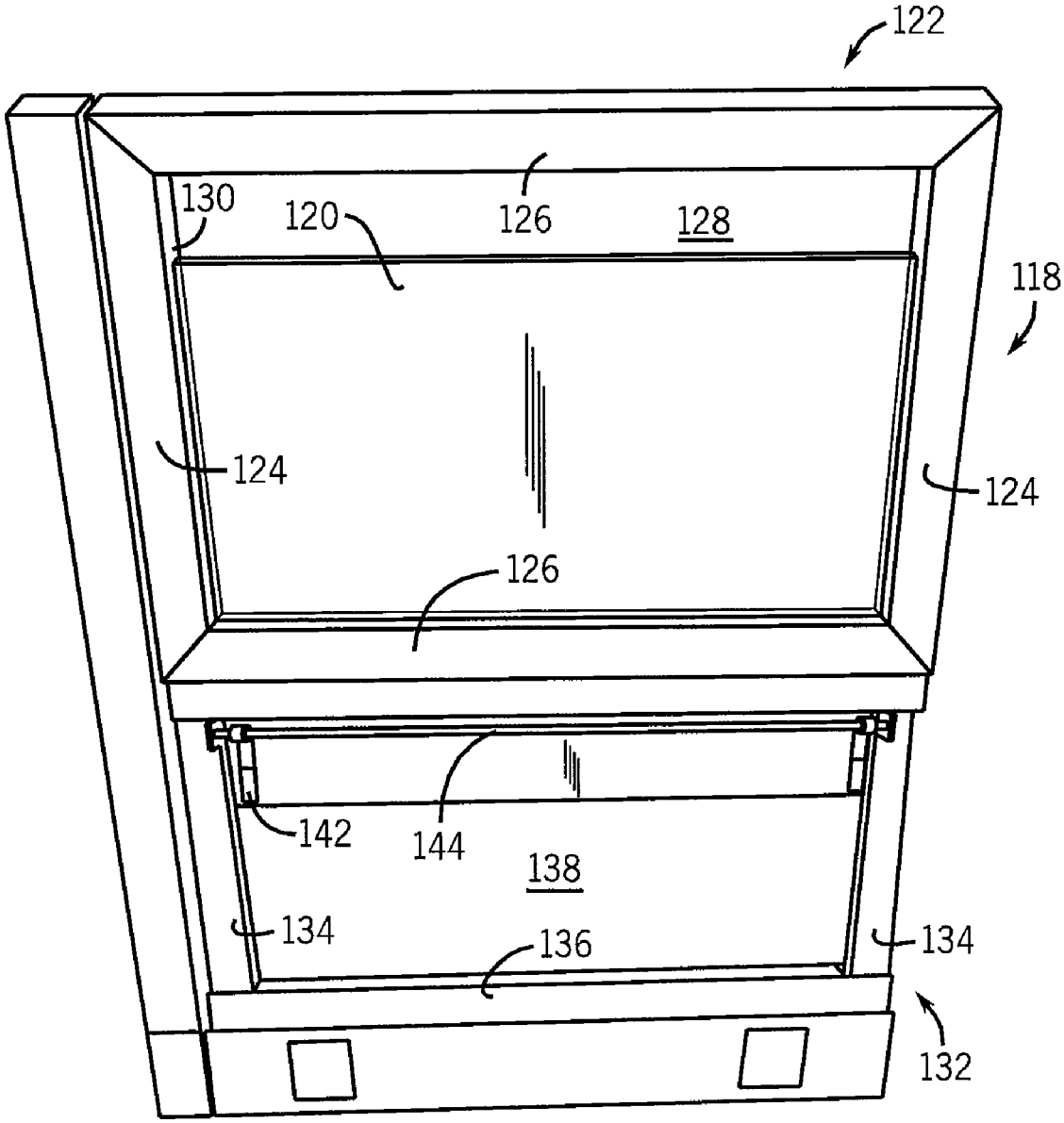
FIG. 14 is a front isometric view of a single encased privacy screen of the workstation shown in FIG. 13.
Figure 15:
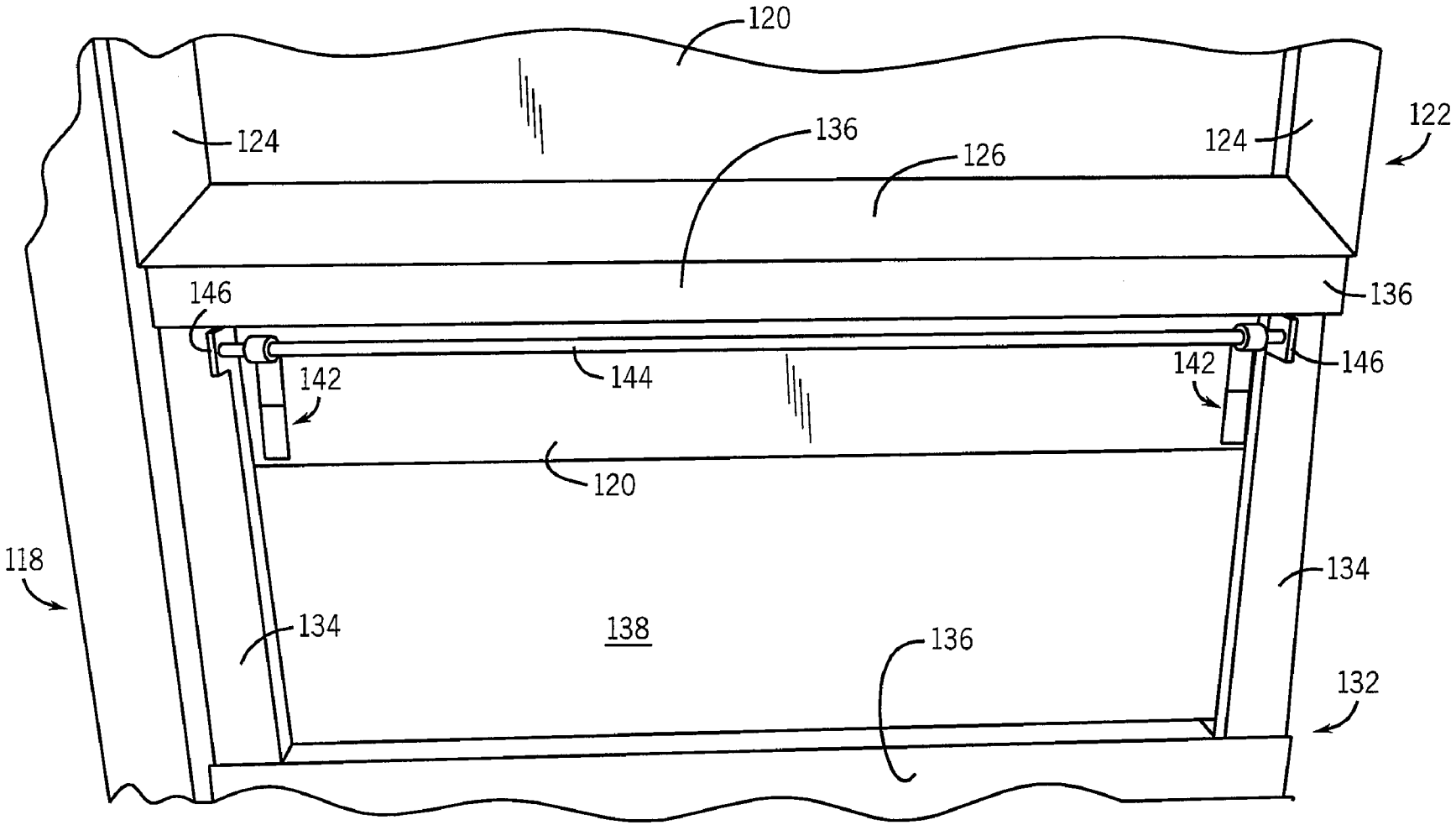
FIG. 15 is a partial elevation view of a portion of the privacy screen shown in FIG. 14.

For example, a privacy screen using or more of the mounting assemblies described herein may be used with a workstation having multiple privacy panels, as illustrated in FIGS. 13-15. In the illustrated example, workstation 114 has a number of worksurfaces 116 enclosed by a series of panels 118. The worksurfaces 114 may be freestanding, coupled to one another, or connected to the panels 118 as is known in the art. One or more of the panels 118 includes a slidable privacy screen 120 that can be moved relative to a frame 122 as desired by a user to define the degree of privacy for the workstation 114. In one embodiment, the privacy screens 120 are formed of translucent or opaque materials; although, it is contemplated that the transparent materials could also be used.

Referring particularly to FIG. 14, each panel 118 has a privacy screen 120 supported by an upper frame 122 and a lower frame 132. The upper frame 122 is defined by a pair of upright members 124 connected to another by a pair of lateral members 126. Collectively, the frame members 124, 126 define an upper opening 128 that can be selectively closed by sliding privacy screen 120 into the opening 128. Each upright member 124 has a groove 130 formed in an inner surface thereof and is designed to slidably receive the privacy screen 120. The lower frame 132 also has a pair of upright members 134 connected to another by a pair of lateral members 136. Members 134, 136 collectively define a lower opening 138 that is closed by sliding the privacy screen 120 into the opening 138. Thus, as the upper opening 128 is closed, the lower opening 138 is opened, and vice-versa.

Referring now to FIG. 15, a pair of constant force biasing springs 142 are coupled to an interior surface of the privacy screen 120 and are interconnected to another by a connecting rod 144. The connecting rod 144 is connected to a pair of flanges 146 extending transversely from the privacy screen 120. The flanges 146 are constructed to ride along the grooves formed in the upright members 124 and 134 as the privacy screen 120 is moved upward and downward. The spring 142 is adapted to supply a constant force on the privacy screen 120 and therefore maintain the position of the privacy screen 120 relative to the frames 122, 132. In addition, the spring supports the weight of the privacy screen 120, similar to that described above with respect to FIGS. 1-12. The connecting rod 144 allows a user to quickly adjust the height of the privacy screen 120.

Various alternatives and embodiments are contemplated as being within the scope of the following claims particularly pointing out and distinctly claiming the subject matter regarded as the invention.

We claim:

1. A height adjustment arrangement for an upright member located adjacent a support structure, comprising:

a guide arrangement for guiding vertical movement of the upright member relative to the support structure, the guide arrangement including a bracket arrangement attached to the support structure and having guide areas engaged with guide grooves formed in the upright member; and a constant force spring arrangement interposed between the guide arrangement and the upright member, the spring arrangement including a spring cylinder and a spring band extending from the spring cylinder and attached to the upright member to apply an upward biasing force on the upright member, the constant force spring arrangement including a mounting screw connected to the bracket arrangement and extending through a passage formed in a bushing located in the spring cylinder, wherein the spring cylinder is rotatable relative to the bracket arrangement about the bushing, the spring band being configured to counterbalance the weight of the upright member and hold the upright member in a plurality of desired vertical positions relative to the support structure without requiring any locking device.

2. The height adjustment arrangement of claim 1 wherein the bracket arrangement includes a barrel defining an internal threaded passage adapted to receive a threaded portion of the mounting screw.

3. The height adjustment arrangement of claim 2 wherein the mounting screw has the threaded portion and a non-threaded portion and wherein the passage through the bushing is non-threaded such that the bushing is free to rotate about the non-threaded portion of the mounting screw where the mounting screw extends through the passage.

4. The height adjustment arrangement of claim 1 wherein the support structure comprises a desk and the upright member comprises a privacy screen.

5. A work apparatus comprising:

a work member including an upwardly facing work surface;

a screen vertically mounted to the work member; and a mounting arrangement for mounting the screen to the work member, the mounting arrangement allowing vertical movement of the screen relative to the work member, the mounting arrangement including a pair of springs that each applies a constant counterbalancing force to the screen for counterbalancing the weight of the screen and maintaining the screen in a plurality of desired vertical positions relative to the work member without requiring any locking device, each spring including a spring cylinder, a spring band extending from the spring cylinder and engaged with the screen, and mounting means interposed between the mounting arrangement and the spring cylinder for rotatably mounting the spring cylinder to the mounting arrangement, the mounting means further including a bushing located in the spring cylinder, the bushing defining a passage, and a mounting screw extending through the passage and connected to the mounting arrangement.

6. The work apparatus of claim 5 further comprising a connecting rod interconnected between the pair of springs.

7. The work apparatus of claim 6 further comprising a pair of tensioning screws each associated with one of the springs.

8. The work apparatus of claim 5 wherein the work member comprises a table top and wherein the screen comprises a privacy screen.

9. The work apparatus of claim 5 wherein the mounting arrangement includes a pair of rack-and-pinion gear assemblies adapted to translate the screen relative to the work member.

10. A combined privacy screen and height adjustment arrangement for movably mounting the privacy screen adjacent an outer edge of a work surface, comprising:

a pair of mounting brackets coupled to the privacy screen for guiding vertical movement of the privacy screen relative to the work surface, the mounting brackets each including guide areas engaged within a guide groove formed in the privacy screen; and a constant force spring arrangement attached to the privacy screen and the mounting bracket, the constant force spring arrangement including a spring cylinder rotatably coupled to the mounting bracket and a spring band extending from the spring cylinder and attached to the privacy screen, the constant force spring arrangement further including a bushing located in the spring cylinder, the bushing defining a passage, and a mounting screw extending through the passage and connected to the mounting bracket wherein the mounting brackets are selectively attachable to the work surface such that the constant force spring applies an upward bias force on the privacy screen to hold the privacy screen in any one of a plurality of desired vertical positions.

11. The combined privacy screen and height adjustment arrangement of claim 10 wherein each of the mounting brackets includes an upper horizontal section for attachment to the work surface.

12. The combined privacy screen and height adjustment arrangement of claim 10 wherein the constant force spring arrangement includes a pair of spring cylinders and spring bands for counterbalancing the weight of the screen.

13. The combined privacy screen and height adjustment arrangement of claim 12 further comprising a connecting rod interconnected between the pair of spring cylinders.

14. The combined privacy screen and height adjustment arrangement of claim 10 further comprising a rack and gear assembly positioned between the spring cylinder and the privacy screen to translate the screen relative to the work surface.

* * * * *